United States Patent [19]

Simson

[11] 4,371,009

[45] Feb. 1, 1983

[54] WEFT YARN ACCUMULATOR

[75] Inventor: Dionizy Simson, Winterthur, Switzerland

[73] Assignee: Sulzer Brothers Limited, Winterthur, Switzerland

[21] Appl. No.: 243,761

[22] Filed: Mar. 16, 1981

[30] Foreign Application Priority Data

Mar. 28, 1980 [CH] Switzerland ..... 2447/80

[51] Int. Cl.[3] ..... D03D 47/34

[52] U.S. Cl. ..... 139/452; 226/119

[58] Field of Search ..... 139/436, 450, 452; 226/172, 170, 171, 173, 119 R

[56] References Cited

U.S. PATENT DOCUMENTS

| | | | |
|---|---|---|---|
| 3,587,664 | 6/1971 | Van Mullekom | 139/452 |
| 3,596,683 | 8/1971 | Dendo | 139/452 |
| 3,871,421 | 3/1975 | Pfarrwailer | 139/452 |
| 3,938,561 | 2/1976 | Scheffel | 139/452 |

FOREIGN PATENT DOCUMENTS

| | | | |
|---|---|---|---|
| 2718476 | 11/1978 | Fed. Rep. of Germany | 139/452 |
| WO80/01392 | 7/1980 | PCT Int'l Appl. | 139/452 |

*Primary Examiner*—Henry Jaudon

*Attorney, Agent, or Firm*—Kenyon & Kenyon

[57] ABSTRACT

A weft yarn accumulator for mixed weaving on a weaving machine. The loop (65) previously formed in the weft yarn (7) on one side of the belt of the store (I) by the leading entraining member is taken up by the oppositely moving trailing entraining member on to the top run of the belt in two loops. Upon reaching the bottom run, the trailing entraining member pays out the two loops which are then picked into the shed seriatim by the picking nozzle. During the picking of the loops — i.e., during the discharge of the store (I) — the other weft yarn is being stored similarly by the second store (II).

9 Claims, 5 Drawing Figures

0°= 720°
360°
360°÷ 540°
540°÷ 720°
Wb/8
Wb/4
II
21
20
45
45'
30
32
24
31
51
22
23
29
50
28
25
33
34
40
57
55
56
53
59
58

WEFT YARN ACCUMULATOR

This invention relates to a weft yarn accumulator. More particularly, this invention relates to a weft yarn accumulator for weaving machines in mixed weaving.

As is known, in mixed weaving on weaving machines, two weft yarns are used with one being picked every other revolution of the machine main shaft, i.e. every 720° of machine rotation. The picking of a weft yarn occurs during approximately one half of one revolution (180°) of the main shaft. Previous storage of the weft yarn occurs during delivery of the other stored yarn.

In order to effect storage of one yarn while the other yarn is being picked, it has been known to provide a weft yarn accumulator on the weaving machine. For example, it has been known from German O.S. No. 2,903,959, particularly FIGS. 9 to 13, to provide a weft yarn accumulator which utilizes endless belts. In this case, each endless belt forms a loop in a respective weft yarn via two yarn entraining members, one of which stores weft yarn by forming a loop and the other of which delivers the stored weft yarn from storage and releases the yarn for picking. However, one disadvantage of this accumulator is that a third belt is required to which the yarn loop formed by one of the other two belts is transferred and then made available for picking.

Accordingly, it is an object of this invention to provide a weft yarn accumulator for weaving machines employing mixed weaving which is of relatively simple construction.

It is another object of the invention to provide a weft accumulator of endless belt type which requires only two belts for feeding two weft yarns.

It is another object of the invention to increase the reliability of a weft yarn accumulator for mixed weaving.

Briefly, the invention provides a weft yarn accumulator for weaving machines in mixed weaving which comprises a pair of endless belts for forming respective yarn stores. Each belt is provided with a pair of yarn entraining members which are mounted thereon for forming yarn loops in the respective store. Further, the entraining members of each belt are spaced one quarter of the belt length apart from one another on opposite sides of the belt and are staggered one half of the belt length from one belt to the other belt.

In addition, separate means are provided for supplying yarns to the respective belts along with various guides for forming the various loops. These guides include a first yarn guide which is located adjacent a first means for supplying a first yarn in order to form a loop of the first yarn with a leading one of the entraining members of one belt during movement of this leading member away from the first guide. Further, a first set of yarn guides is disposed in a triangular array mid-way of the belt for forming a double loop of the first yarn with a trailing one of the entraining members of the belt during movement of the leading member towards the first guide and the trailing member away from the first guide.

A second yarn guide is located adjacent the second means for supplying the second yarn in order to form a loop of the second yarn with a leading one of the entraining members of the other belt during movement of the leading member of this belt away from the second guide. As above, a second set of yarn guides is disposed in a triangular array mid-way of this second belt for forming a double loop of the second yarn with a trailing one of the entraining members of the second belt during movement of the leading member of the belt towards the second guide and the trailing member of the belt away from the second guide.

The accumulator is operated so that picking of the yarns occurs in alternation with picking of one yarn during movement of the trailing member of one belt towards the first guide and picking of the second yarn during movement of the trailing member of the second belt towards the second guide.

The accumulator may also be provided with additional guides for receiving the yarns from the respective stores for delivery to a shed in the weaving machine.

Further, the accumulator is provided with means for driving the belts in synchronism. For example, the belts may each have an external tooth system in meshing engagement with one another while one belt is entrained on a pulley connected to a drive shaft so that both belts are driven simultaneously during rotation of the drive shaft.

During operation, the loop of weft yarn formed on one side of one belt of one store is subsequently received on the other side of the same belt in two loops which are picked consecutively. During picking of the loop, i.e., during the "discharge" of the store, the other weft yarn is being taken into storage by the second store.

These and other objects and advantages of the invention will become more apparent from the following detailed description taken in conjunction with the accompanying drawings wherein.

Figure 1:
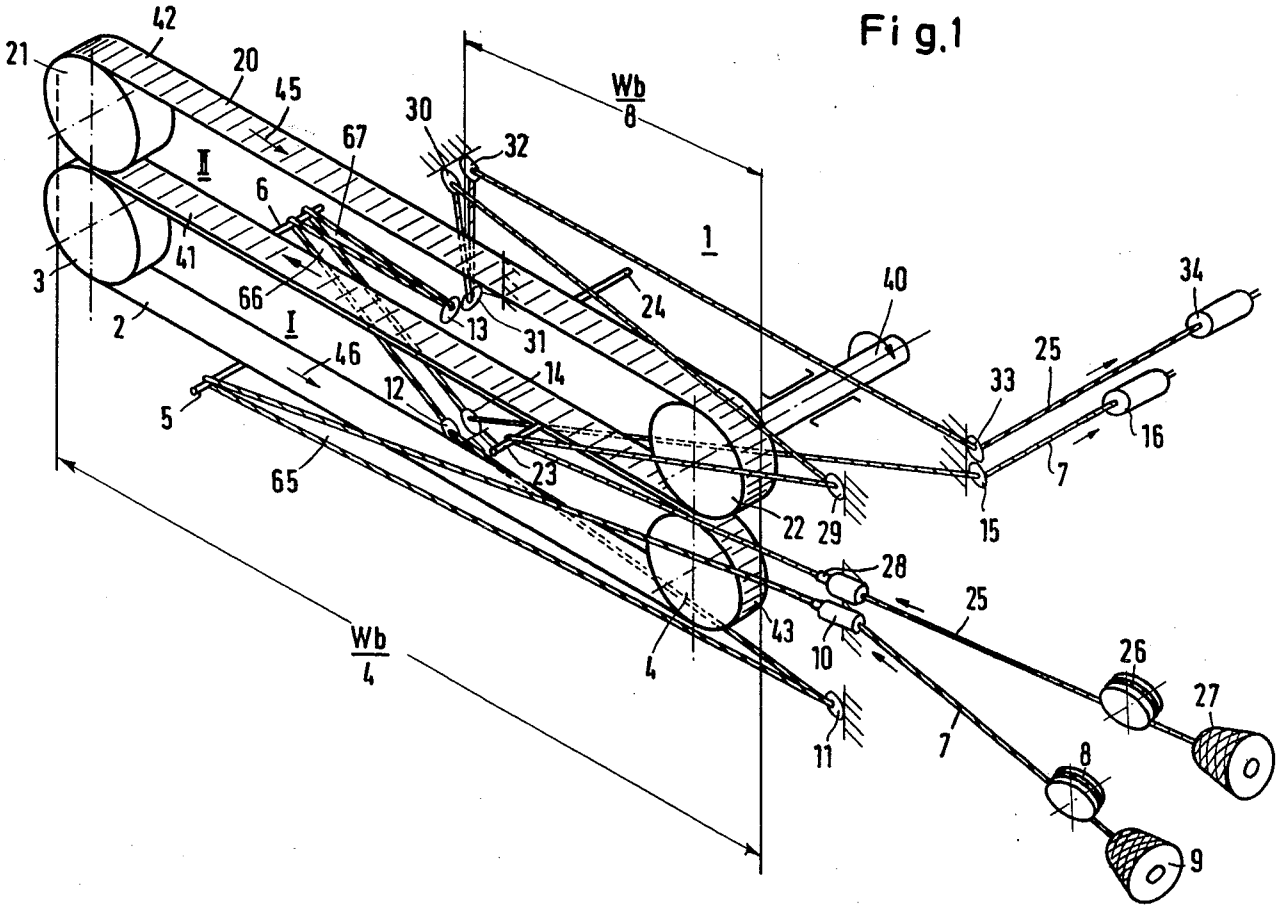
FIG. 1 illustrates a schematic view of a weft yarn accumulator in accordance with the invention.

Referring to FIG. 1, the weft accumulator 1 comprises two identical stores I, II.

One store I includes an endless belt 2 which is entrained about two rotatable pulleys, or the like, 3,4. The belt carries a pair of yarn entraining members 5, 6 each of which is in the form of a pin. As indicated, the entraining members 5, 6 are spaced one quarter of the belt length apart from each other on opposite sides of the belt 2.

As shown, a weft yarn 7 is delivered to the store I via a dispensing roller, drum or the like 8 from a bobbin 9. The delivery of the weft yarn 7 is continuous and occurs at a constant speed. In the position illustrated, the accumulator 1 has a means in the form of a nozzle 10 (or other yarn guide) for supplying the yarn 7 to the belt 2. A yarn guide 11 is also disposed adjacent the nozzle 10 for forming a loop of the yarn 7 with the leading entraining member 5 on the belt 2 during movement of the leading member 5 away from the guide 11.

In addition, a set of yarn guides 12, 13, 14 is disposed in a triangular array mid-way of the belt 2 for forming a double loop of the yarn 7 with the trailing entraining member 6 during movement of the leading member 5 and the trailing member 6 in a direction away from the guide 11. A further yarn guide 15 is also provided for receiving the yarn 7 from the set of yarn guides 12, 13, 14 for delivery to a shed (not shown), for example via an air picking nozzle 16. Of note, the nozzle 10 and yarn guides 11–15 are fixedly disposed.

In the position illustrated, the yarn 7 passed from the dispensing roller 8 through the nozzle 10 to the entraining member 5, yarn guide 11, yarn guides 12, 13, 14 and thence yarn guide 15 to the picking nozzle 16.

The store II has a belt 20 entrained about two rotatable pulleys 21, 22. As above, the belt 20 has two yarn entraining members 23, 24 in the form of pins which are spaced one quarter of the belt length apart from another on opposite sides of the belt 20. In addition, the entraining members 23, 24 are staggered one half of the belt length from the entraining members 5, 6 of the other belt 2.

A weft yarn 25 is removed continuously and at constant speed from a bobbin 27 via a dispensing drum or roller 26 for delivery to the store II. In similar manner as above, the yarn 25 passes to a means in the form of a nozzle 28 for delivery to the belt 20. Further, a yarn guide 29 is disposed adjacent the nozzle 28 in order to form a loop of the yarn 25 with the leading entraining member 23 on the belt 20 during movement of the leading member away from the guide 29. A second set of yarn guides 30, 31, 32 is disposed in triangular array mid-way of the belt 20 for forming a double loop of the yarn with the trailing entraining member 24 during movement of the leading member 23 towards the guide 29 and the trailing member 24 away from the guide 29.

A further guide 33 is provided for receiving the yarn 25 from the yarn guides 30, 31, 32 for delivery to the shed (not shown), for example via an air picking nozzle 34.

As indicated, the yarn 25 passes through the nozzle 28, about the pin 23, the yarn guide 29, the yarn guides 30, 31, 32 and the yarn guide 33 to the picking nozzle 34.

The spacing between the pulleys 3, 4 and the pulleys 21, 22 is such that the distance between the reversing positions of the belts 2, 20 corresponds to one quarter of the width of the required fabric in the weaving machine. The yarn guides 12, 13, 14 associated with the store I and the yarn guides 30, 31, 32 associated with the store II are disposed in coplanar relationship perpendicularly to the length and centrally between the reversing positions of the respective belts 2, 20. That is, each set of yarn guides is at a distance of one eighth of the weaving width from the reversing positions. The guides 12, 13, 14 form a substantially equilateral triangular in which the guides 12, 14 are the base vertices. Likewise, the yarn guides 30, 31, 32 form an isosceles triangle in which the guide 30, 32 are the base vertices.

Of note, in an appropriate arrangement of the nozzles 16, 34, the yarn guides 15, 33 may be eliminated.

A suitable means is provided for driving the belts 2, 20 in synchronism. For example, as shown, the pulley 22 of the store II is connected to a drive shaft 40 so as to be driven by the weaving machine and includes a tooth system (not shown ) which meshes with a matching inner tooth system 41 on the belt 20. Each belt 2, 20 also has an external tooth system 43, 42, respectively, which are in meshing engagement with one another. Thus, the belts 2, 20 are positively engaged with one another and with the driven pulley 22 to run at the same speed as one another. The two belts 2, 20 can alternatively be interconnected by way of their drive, for example by way of gears or may have an independent drive. If the shaft 40 rotates clockwise, as viewed, the belt 20 of the store II also rotates clockwise in the direction indicated by the arrow 45 whereas the belt 2 of the store I rotates counter clockwise as indicated by the arrow 46. However, both belts 2, 20 can, if required, run in the same direction.

The operation of the accumulator is described with reference to FIGS. 1 to 5. However, for the sake of clarity, only the top store II is illustrated in FIGS. 2 to 5.

Figures 2, 3, 4, 5:
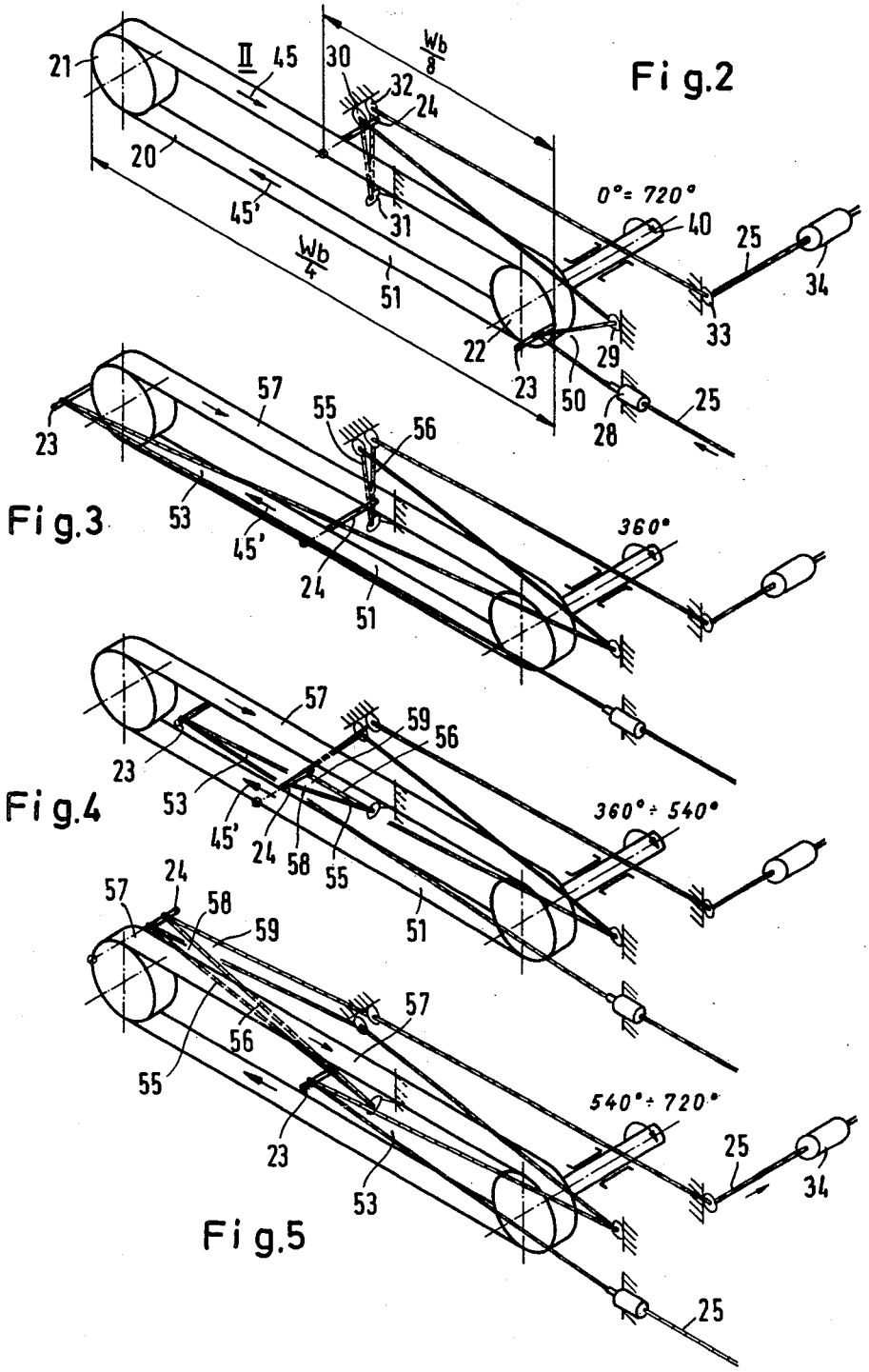
FIG. 2 illustrates one endless belt of the accumulator of FIG. 1 in an initial position.
FIG. 3 illustrates the endless belt of FIG. 2 in a position during formation of one loop.
FIG. 4 illustrates the endless belt of FIG. 2 in a position during transfer of the loop from one entraining member to the double loop on the other entraining member.
FIG. 5 illustrates the endless belt of FIG. 2 in a position of discharge.

Referring to FIG. 2, the store II is in a position immediately after the yarn 25 has been delivered to the picking nozzle 34. In this position, the store II is about to start storing the next length of the yarn 25 for a pick. As indicated, the yarn 25 is disposed about the entraining member 23 so as to form a very small loop 50. The trailing entraining member 24 is at the reversal positions of the yarn 25 where the yarn 25 passes through the yarn guides 30, 31, 32. Expressed in terms of machine main shaft rotation, the store II is in the 720°, i.e. zero degree, position.

The yarn 25 is removed continuously from the bobbin 27 (see FIG. 1) by means of the drum 26 and is supplied at a constant speed to the nozzle 28 of the store II. As this occurs, the movement of the bottom run 51 of the belt 20 in the direction indicated by the arrow 45' away from the guide 29 increases the size of the loop 50 entrained by the leading member 23 to the maximum size loop 53 as shown in FIG. 3. This increase in size occurs during rotation of the main shaft from zero degrees to 360°. The yarn length shown is then 2 (Wb/4), i.e. half the weaving width.

As shown in FIG. 3, the trailing entraining member 24 on the other side of the belt 20 is now at the center of the bottom run of the belt 20 before the runs 55, 56 of the yarn 25 within the set of yarn guides 30–32.

Referring to FIG. 4, as the leading entraining member 23 moves along the top run 57 of the belt 20, the loop 53 is paid out and is simultaneously taken up by the trailing entraining member 24 which is moving in the opposite direction on the bottom run 51 away from the guide 59. The trailing entraining member 24 thus forms two loops 58, 59 of the yarn.

Referring to FIG. 5, when the trailing entraining member 24 reaches the top run 57 of the belt 20, the "discharge" of the store II starts. That is, the trailing member 24 starts to pay out the loops 58, 59 which are then picked consecutively into the shed (not shown) by the pull of the picking nozzle 34. This step occurs during rotation of the main shaft from 540° to 720°.

At the completion of picking, the loops 58, 59 are dissipated as indicated in FIG. 2. At the same time, the loop 53 on the leading entraining member 23 has been reduced to the small loop 50 as shown in FIG. 2.

During picking of the loops 58, 59, i.e. during "discharge" of the top store II, the yarn 7 is being stored by the lower store I, the storage occurring during rotation from 360° to 720°, i.e. to zero degrees. The store I is therefore in the position corresponding to that shown in FIG. 3 for the store II but moves in the opposite direction. The storage and discharge steps for the yarn 7 in the store I are the same as described above for the store II. As shown in FIG. 1, the leading entraining member 5 of the belt 2 is paying out a loop 65 in the yarn 7 which is taken up by the oppositely moving trailing entraining member 6 on the top run of the belt 2 in the form of two loops 66, 67. When the trailing member 6 reaches the bottom run of the belt 2, the double loops 66, 67 start to pay out and are then picked into the shed consecutively by the picking nozzle 16.

The accumulator has been described in connection with a weaving machine in which the picking agent is air. However, the accumulator may, of course, be used for a weaving machine having some other form of picking, for example for a gripper projectile weaving machine.

The invention thus provides a weft accumulator for weaving machines and mixed weaving which is of relatively simple construction and which uses a minimum of parts for picking.

What is claimed is:

1. A weft yarn accumulator for weaving machines in mixed weaving, said accumulator comprising a pair of endless belts for forming respective yarn stores, each belt having a pair of yarn entraining members mounted thereon for forming yarn loops in a respective store;

said entraining members of each belt being spaced one-quarter of the belt length apart from one another on opposite sides of said belt and being staggered one-half of said belt length from one belt to the other belt;

a first and a second yarn guide located on the side where a yarn enters a respective store and disposed on the side of one of said entraining members of one belt;

a third, fourth and fifth yarn guide disposed centrally between the reversing points of said belt of one store and on the side of the other entraining member of said belt;

said third and fourth yarn guide being the base vertices of the resulting triangle, the free end of a yarn passing consecutively around said entraining member on said one side of the belt, through said first yarn guide and said third yarn guide, around said entraining member on said other side of said belt, through said fifth yarn guide, again around said last-mentioned entraining member and through said fourth yarn guide to a shed;

a sixth, seventh and eighth yarn guide disposed centrally between the reversing points of said belt of the second store and on the last-mentioned side of said belt;

said seventh and eight yarn guides being the base vertices of the resulting triangle; and a free part of the other yarn passing consecutively around said last-mentioned entraining member, through said second, seventh, sixth and eighth yarn guide to the shed.

2. An accumulator as set forth in claim 1 wherein said belts each have an external tooth system in meshing engagement with one another.

3. A weft yarn accumulator comprising a pair of endless belts, each said belt being of predetermined length;

two pairs of yarn entraining members, each said pair of entraining members being disposed on a respective belt with said members on each belt being spaced one-quarter of said belt length apart from each other on opposite sides of said belt and being staggered one-half of said belt length from one belt to the other belt;

a first means for supplying a first yarn to one of said belts;

a first yarn guide adjacent said first means for forming a loop of the first yarn with a leading one of said entraining members of said one belt during movement of said leading member away from said first guide;

a first set of yarn guides disposed in a triangular array mid-way of said one belt for forming a double loop of the first yarn with a trailing one of said entraining members of said one belt during movement of said leading member towards said first guide and said trailing member away from said first guide;

a second means for supplying a second yarn to the other of said belts;

a second yarn guide adjacent said second means for forming a loop of the second yarn with a leading one of said entraining members of said other belt during movement of said leading member of said other belt away from said second guide; and a second set of yarn guides disposed in a triangular array mid-way of said other belt for forming a double loop of the second yarn with a trailing one of said entraining members of said other belt during movement of said leading member of said other belt towards said second guide and said trailing member of said other belt away from said second guide;

whereby picking of the yarns occurs in alternation with picking of the first yarn during movement of said trailing member of said one belt towards said first guide and picking of the second yarn during movement of said trailing member of said other belt towards said second guide.

4. A weft yarn accumulator as set forth in claim 3 wherein each of said sets of yarn guides includes three yarn guides.

5. A weft yarn accumulator as set forth in claim 3 which further includes a third yarn guide for receiving the first yarn from said first set of yarn guides for delivery to a shed; and a fourth yarn guide for receiving the second yarn from said second set of yarn guides for delivery to the shed.

6. A weft yarn accumulator as set forth in claim 3 which further comprises means for driving said belts in synchronism.

7. A weft yarn accumulator as set forth in claim 3 wherein each belt has an external tooth system in meshing engagement with one another and which further comprises a drive shaft and a pulley connected to said shaft and having one of said belts entrained thereon.

8. A weft yarn accumulator comprising an endless belt having a pair of entraining members spaced one-quarter of the belt length apart on opposite sides of said belt for forming yarn loops in a store;

a means for supplying yarn to said store;

a yarn guide adjacent said means for forming a loop of the yarn with a leading one of said members during movement of said leading member away from said guide; and a set of yarn guides disposed in a triangular array mid-way of said belt for forming a double loop of yarn with a trailing one of said members during movement of said leading member towards said guide and said trailing member away from said guide.

9. A weft yarn accumulator as set forth in claim 8 which further comprises a yarn guide for receivng the yarn from said set of yarn guides for delivery to a shed.

* * * * *